US006371019B1

(12) United States Patent
Bösen et al.

(10) Patent No.: US 6,371,019 B1
(45) Date of Patent: Apr. 16, 2002

(54) POSITIONING DEVICE IN A PRINTING MACHINE AND METHOD OF OPERATION

(75) Inventors: Kurt Bösen, Bretten; Jens Friedrichs, Neckargemünd; Markus Künzel, Darmstadt; Frank Schaum, Neckargemünd, all of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/428,580

(22) Filed: Oct. 28, 1999

(30) Foreign Application Priority Data

Oct. 28, 1998 (DE) ..... 198 49 634

(51) Int. Cl.[7] ..... B41F 5/00

(52) U.S. Cl. ..... 101/216; 101/247; 101/479

(58) Field of Search ..... 101/479, 480, 101/171, 174, 182, 184, 185, 212, 216, 218, 247, 248, 374; 254/266, 312, 270, 279, 280; 414/569, 911; 248/327, 332

(56) References Cited

U.S. PATENT DOCUMENTS

| | | | | |
|---|---|---|---|---|
| 3,789,676 A | * | 2/1974 | Brems | 74/27 |
| 4,138,944 A | * | 2/1979 | Biggar, III | 101/247 |
| 4,202,266 A | * | 5/1980 | Zahradnik | 101/218 |
| 4,231,292 A | * | 11/1980 | Stolle | 101/137 |
| 4,421,027 A | | 12/1983 | Fischer | |
| 4,617,865 A | | 10/1986 | Switall | |
| 4,774,883 A | * | 10/1988 | Mailander | 101/137 |
| 4,848,265 A | | 7/1989 | Komori | |
| 4,934,305 A | | 6/1990 | Koehler et al. | |
| 5,154,602 A | * | 10/1992 | Harrison | 101/351 |
| 5,282,417 A | * | 2/1994 | Germann | 101/152 |
| 5,333,545 A | | 8/1994 | Ganter et al. | |
| 6,041,706 A | * | 3/2000 | Murray | 101/217 |

FOREIGN PATENT DOCUMENTS

| | | |
|---|---|---|
| DE | 31 16 505 A1 | 11/1982 |
| DE | 35 25 743 A1 | 1/1987 |
| DE | 69022419 | 6/1990 |
| DE | 42 26 392 C1 | 11/1993 |
| DE | 42 18 422 C2 | 4/1994 |
| DE | 39 41 571 C2 | 6/1995 |
| DE | 197 32 796 A1 | 4/1998 |
| DE | 197 08 434 A1 | 9/1998 |
| EP | 0 276 417 A2 | 8/1988 |
| EP | 0 741 025 A2 | 11/1996 |

OTHER PUBLICATIONS

German Utility Model G 92 06 416.7, dated Aug. 6, 1992, varnishing unit for a printing press.

* cited by examiner

*Primary Examiner*—Eugene Eickholt
(74) *Attorney, Agent, or Firm*—Herbert L. Lerner; Laurence A. Greenberg; Werner H. Stemer

(57) ABSTRACT

A device for selectively positioning at least one cylinder in a printing machine, the cylinder being rotatably mounted in a carrier and, together with the carrier, forming a unit that is adjustable into different positions, includes a pull mechanism drive for adjusting one of the cylinder and the unit into the different positions, the pull mechanism drive including a pull mechanism, the unit being held on and suspended from the pull mechanism.

12 Claims, 5 Drawing Sheets

27
28
6,54
32
25
31,54
63
8
50
3
33
29
9
63
6,62
31,62
56
31,55
57
6,55
7,55
33
58
60
4
47
48
49
36
43
24
23
7,62
42
46
41
19
20
44
40
18
39
45
38
22
37
5
17
30
10
15
59
M
14
13
21
12
11
53
16
26
35

POSITIONING DEVICE IN A PRINTING MACHINE AND METHOD OF OPERATION

BACKGROUND OF THE INVENTION

Field of the Invention

The invention relates to a device for selectively positioning at least one cylinder in a printing machine, the cylinder being rotatably mounted in a carrier and, together with the carrier, forming a unit adjustable into different positions, and to a method for operating a printing machine including a positioning device and a cylinder that is adjustable into different positions along an adjusting path, the adjustable cylinder cooperating with a cylinder for guiding printing material or stock.

Positioning devices of this type are used to adjust the cylinder into an operating position and into a rest or maintenance position within the printing machine.

A coating device for printing machines is described, for example, in U.S. Pat. 4,617,865. The device includes a frame that is movable on rails and has a feed roller. The frame is drivable by a ball-screwthread transmission having ball-screwthread nuts which are rotatively drivable by a motor via a link chain. The ball-screwthread nuts, the motor and the link chain are mounted in the frame and are movable together with the latter. The frame and the cylinder are not held by the link chain.

Furthermore, the German Pat. Document DE 69022419 T2 that corresponds to U.S. Pat. 4,934,305 describes a further coating device with a retraction device in the form of a winch for retracting the coating device. A form-paired or paired-form pulling or tensioning device, i.e., paired as to form or shape, such as a chain or a toothed belt, is not provided in this reference.

The aforedescribed positioning devices are well suited for their respective applications, but cannot be used for other applications.

SUMMARY OF THE INVENTION

It is accordingly an object of the invention, therefore, to provide a further positioning device for use in printing machines, that provides added advantages to those of the positioning device heretofore used therein.

It is a further object of the invention to provide a method with time-optimized method steps for operating the printing machine including the positioning device and for putting the positioning device into operation, respectively.

With the foregoing and other objects in view, there is provided, in accordance with one aspect of the invention, a device for selectively positioning at least one cylinder in a printing machine, the cylinder being rotatably mounted in a carrier and, together with the carrier, forming a unit that is adjustable into different positions, comprising a pull mechanism drive for adjusting one of the cylinder and the unit into the different positions, the pull mechanism drive including a pull mechanism, the unit being held on and suspended from the pull mechanism.

In accordance with another feature of the invention, the pull mechanism drive is a form-paired pull mechanism drive.

In accordance with a further feature of the invention, the pull mechanism drive is a chain drive.

In accordance with an added feature of the invention, the pull mechanism is a link chain.

In accordance with an additional feature of the invention, the positioning device includes a spring connecting an end of the pull mechanism to the carrier.

In accordance with yet another feature of the invention, the positioning device includes at least two wheels for guiding the chain drive, the wheels being form-paired with the chain drive.

In accordance with yet a further feature of the invention, the cylinder is an applicator cylinder for applying a coating to a printing material.

In accordance with yet an added feature of the invention, the positioning device includes at least another cylinder rotatably mounted in the carrier.

In accordance with yet an additional feature of the invention, the positioning device includes a guide whereon the carrier is seatable.

In accordance with still another feature of the invention, the guide is formed as at least one roller whereon the carrier is seatable.

In accordance with still a further feature of the invention, the carrier is liftable and lowerable together with the cylinder through the intermediary of the pull mechanism drive in a linear and an approximately vertical direction of motion selectively into the different positions.

In accordance with another aspect of the invention, there is provided a printing machine including at least one positioning device having at least one of the foregoing features.

In accordance with a concomitant aspect of the invention, there is provided a method for operating a printing machine having a positioning device with a cylinder that is adjustable into different positions along an adjustment path and cooperating with a cylinder for guiding printing material, which comprises performing at least two of the following method steps a) to d), including performing the two method steps at least partly simultaneously:

a) adjusting the rotational angle of the cylinder guiding the printing material into a given position;
b) adjusting the rotational angle of the cylinder that is adjustable along the adjustment path into a given position;
c) adjusting the circumferential register of the cylinder that is adjustable along the adjustment path; and
d) adjusting the cylinder that is adjustable along the adjustment path, from a first cylinder position into a second cylinder position along the adjustment path, with the aid of the positioning device.

The device described in the published German Patent Document DE 69022419 T2 can preferably be equipped for circumferential and lateral register adjustment in order to allow accurate positioning of the plate. No method of operating the printing machine including the device is indicated. The chronological course of the adjusting operations required for putting the device into operation is not optimized, and the time required for setting up cannot therefore be reduced.

Thus, the device for positioning at least one cylinder selectively in a printing machine, the cylinder being rotatably mounted in a carrier and, together with the carrier, forming a unit that is adjustable into different positions, includes a pull mechanism drive that adjusts the cylinder or unit into position and has a pull mechanism, the unit being held on and suspended from the pull mechanism.

The unit can be suspended from and held, respectively, on the pull mechanism so as to be completely free, e.g., in a manner comparable to that for an elevator, or with additional guidance, lying, for example, on a sloping plane. The pull mechanism can be a chain or a cable or a belt, and can be secured on the carrier and be a finite pull mechanism. Preferably, the pull mechanism drive is motor-driven.

An advantageous embodiment, which represents a further development of the device according to the invention, calls for the pull mechanism drive to be a form-paired or paired-form pull mechanism drive and, in particular, a chain mechanism.

The category of pull mechanism drives includes not only cable winches and frictionally acting V-belt mechanisms, for example, but also paired-form pull mechanism drives in which a drive and/or guide wheel and the pull mechanism formlockingly engage in one another.

The category of paired-form pull mechanism drives includes not only toothed-belt mechanisms with toothed wheels engaging in the toothed belts but also the preferred chain mechanisms with chain wheels engaging in the chain.

The paired-form pull mechanism drives permit very accurate positioning of the unit and the adjustment thereof over a comparatively large adjustment travel distance.

In a further embodiment, the pull mechanism is a link chain.

In link chains, the individual chain links are connected to one another articulatedly, as is the case, for example, with roller chains.

In a further embodiment, one end of the pull mechanism is connected to the carrier by a spring.

The carrier and the unit, respectively, preferably form an intermediate member which connects the two ends of the pull mechanism. In this regard, the pull mechanism is a finite pull mechanism that does not revolve. A first end of the pull mechanism can hold the unit from above and be connected to or secured on the carrier in an unsprung manner. The second end of the pull mechanism can be connected to a resilient element, e.g., a tension spring, that forms an intermediate member between the second end of the pull mechanism and the carrier and is secured on the carrier. The second end of the pull mechanism can, for example, be connected to one end of a helical spring, the other end of the helical spring being secured on the carrier. In this way, that end of the pull mechanism which does not lift the unit can be suspended and adjusted in a sprung manner on the carrier. However, the pull mechanism can also be a revolving, endless pull mechanism, e.g., a continuous toothed belt.

In a further embodiment, the pull mechanism is guided by at least two wheels. The pull mechanism preferably extends over more than two wheels. The wheels engage formlockingly in the pull mechanism and can, for example, be toothed wheels or chain wheels. In this regard, it is noted that a formlocking connection is one that connects two elements together due to the shape of the elements themselves, as opposed to a forcelocking connection that locks the elements together by force external to the elements. It is further noted that one of the wheels can be driven and can drive the pull mechanism. The wheels guide the pull mechanism and can deflect it into a different travel direction, for example.

In a further embodiment, the cylinder is an applicator cylinder for applying a coating to a printing material.

The coating can be a powdered toner or, preferably, a coating liquid, e.g., a printing ink or a varnish.

The applicator cylinder can be a printing cylinder, e.g., a rubber blanket or printing-plate cylinder, or a varnishing cylinder, e.g. a varnishing-blanket or varnishing-plate cylinder. Rather than being an applicator cylinder, however, the cylinder can be a processing cylinder fitted with tools for processing the printing material and can, for example, be a cutting, creasing, perforating, stamping, smoothing, cleaning or embossing cylinder.

In a further embodiment, at least one further cylinder is rotatably mounted in the carrier.

The cylinder and the further cylinder mounted in the carrier are preferably arranged so as to be axially parallel to one another and in circumferential contact with one another or so as to have a very small spacing between the circumferential outer surfaces thereof. For example, the cylinder can be an applicator cylinder and the further cylinder can be a metering, dipping or anilox roller that is associated with the applicator cylinder and feeds the coating liquid to the applicator cylinder.

In a further embodiment, the carrier can be placed onto a guide.

The carrier and the unit, respectively, can be lowered by the pull mechanism and, in the process, placed onto the guide and lifted again from the latter. In this case, the guide can act like a stop against which the unit strikes during a substantially vertical adjustment downwards, for example. The guide can, for example, be in the form of rails onto which the carrier can be placed.

In a further embodiment, the carrier can be placed on at least one roller acting as the guide.

The roller can be formed as an eccentric roller that is rotatable about an off-center eccentric bearing. The eccentric roller or another roller onto which the unit can be placed can also be formed as a roller pivotable about a pivot bearing.

In a further embodiment, the carrier can be lifted and lowered together with the cylinder by the pull mechanism in a linear and exactly or almost vertical direction of motion into position, selectively.

This embodiment is very advantageous with regard to the accessibility of the unit comprising the carrier and the cylinder and with regard to the installation space required if the positioning device is part of a finishing unit processing or coating the printing material and is, for example, integrated into a varnishing unit.

The device according to the invention can be used in rotary printing machines which print web-like or sheet-like printing material and can be formed as an offset printing machine.

As noted hereinbefore, the method for operating a printing machine, in particular, a printing machine with a positioning device constructed as described hereinabove, which includes a positioning device having a cylinder that is adjustable into various positions along an adjustment path and cooperates with a cylinder guiding printing material, comprises at least two of the following method steps a) to d), the two method steps being performed at least partly simultaneously:

a) adjusting the rotational angle of the cylinder guiding the printing material into a specific position;
b) adjusting the rotational angle of the cylinder that is adjustable along the adjustment path into a specific position;
c) adjusting the circumferential register of the cylinder that is adjustable along the adjustment path; and
d) adjusting the adjustable cylinder from a first cylinder position into a second cylinder position along the adjustment path, using the positioning device.

The adjustable cylinder is preferably movable into the respective positions along a linear adjustment path. In this case, the device according to the invention can be used with the pull mechanism for performing the method. However, the method can furthermore also be used in printing machines which have a positioning device formed in some other way. For example, the cylinder can be pivoted into the corresponding positions by a positioning device of this type. The advantages of the method according to the invention result from the chronological overlap or parallel progress of a number of actuating operations needed to put the printing machine into operation. It is preferable if different drives of the printing machine, driving individual actuating or adjusting processes a) to d) are controlled by an electronic control device so that they are coordinated with one another, and chronologically with the method steps to be performed.

Other features which are considered as characteristic for the invention are set forth in the appended claims.

Although the invention is illustrated and described herein as embodied in a positioning device in a printing machine, and method of operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
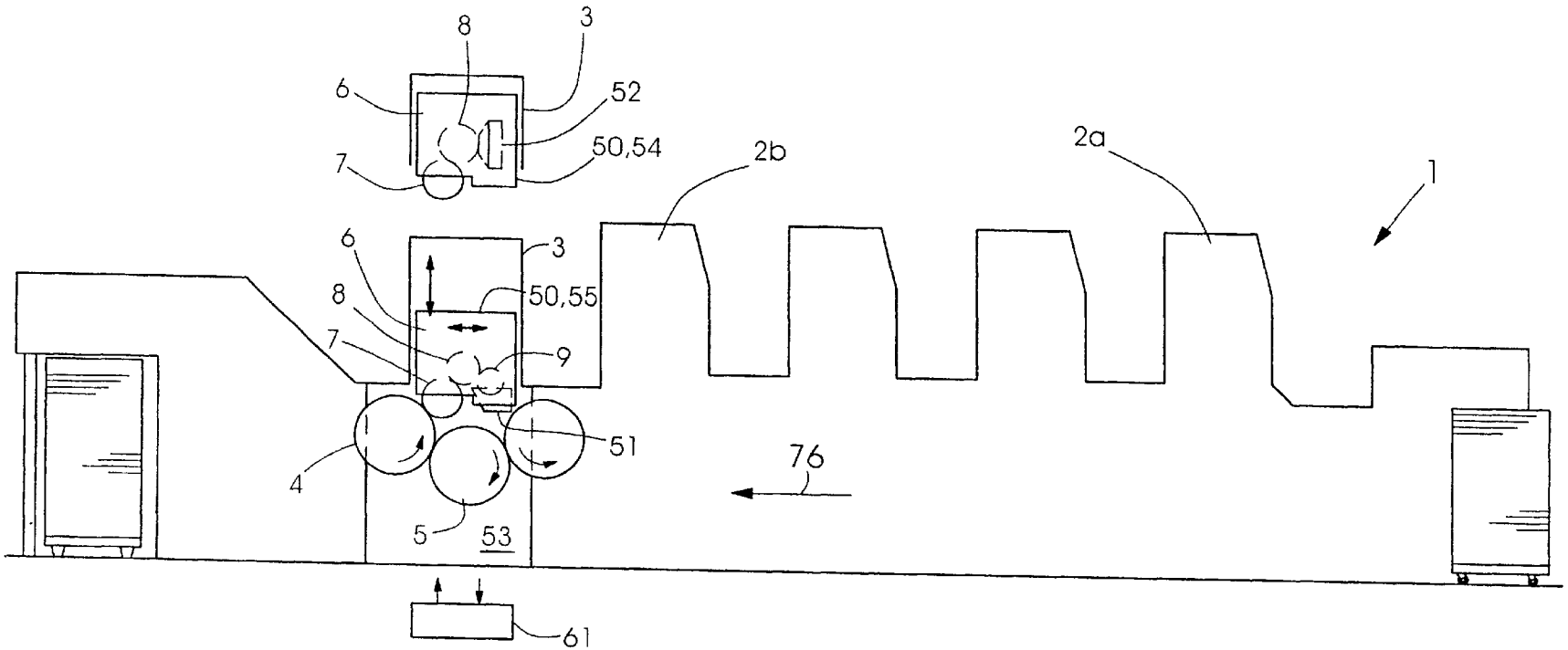
FIG. 1 is a diagrammatic side elevational view of a printing machine with a finishing unit, in which the positioning device according to the invention is integrated.

Referring now to the drawings and, first, particularly to FIG. 1 thereof, there is shown therein a printing machine 1 constructed as an in-line sheet-fed rotary offset printing machine and having a finishing unit 3. As viewed in the sheet transport direction represented by the horizontal arrow 76, the finishing unit 3 is preferably arranged downline of the last printing unit 2*b*, as is shown, but may be disposed upline of the first printing unit 2*a*, as viewed in the sheet transport direction represented by the arrow 76. The printing machine 1 may also include two or more finishing units 3. The finishing unit 3 is of modular construction, it being possible for different units 50 to be installed or inserted selectively into the frame 53 of the finishing unit 3. For example, the units 50 may be used for coating, i.e., varnishing, for example, or for processing, for example embossing, the printing material or stock, and may also be printing, impression, numbering or other finishing modules. Illustrated in FIG. 1 are two units 50 constructed as coating units for varnishing the printing material, each of the coating units 50 having an applicator cylinder 7 for applying a coating liquid to the printing-material sheet lying on an impression cylinder 4. The unit 50 located in the operating position 62 (note FIG. 2) has a feeding device for feeding a highly viscous coating liquid to the cylinder 7, which includes a trough or pan 51 wherein the coating liquid is stored, a dip roller 9 which scoops up the coating liquid and dips into the trough or pan 51, and a metering roller 8 for transferring the coating liquid to the applicator cylinder 7. This unit 50 can be replaced by another unit 50, that is illustrated in an elevated maintenance position 54 at the top of FIG. 1, the other unit 50 in the position 54 having a carrier 6 wherein, in addition to the cylinder 7, at least one further cylinder 8 is also rotatably mounted. Also in this unit 50 at the position 54, the further cylinder 8 mounted in the carrier 6 is in circumferential contact with the cylinder 7. In the case of the last-mentioned unit 50 in the position 54, a feeding system is suitable for feeding a low-viscosity coating liquid, and includes the roller 8 in the form of an anilox or screen roller and a chambered doctor blade 52 assigned to the latter. Depending upon the condition of the coating liquid, for example, the varnish, the units 50 can be inserted into the finishing unit 3 by the operator of the printing machine 1, and can be used selectively for in-line finishing of the printed products.

Figure 2:
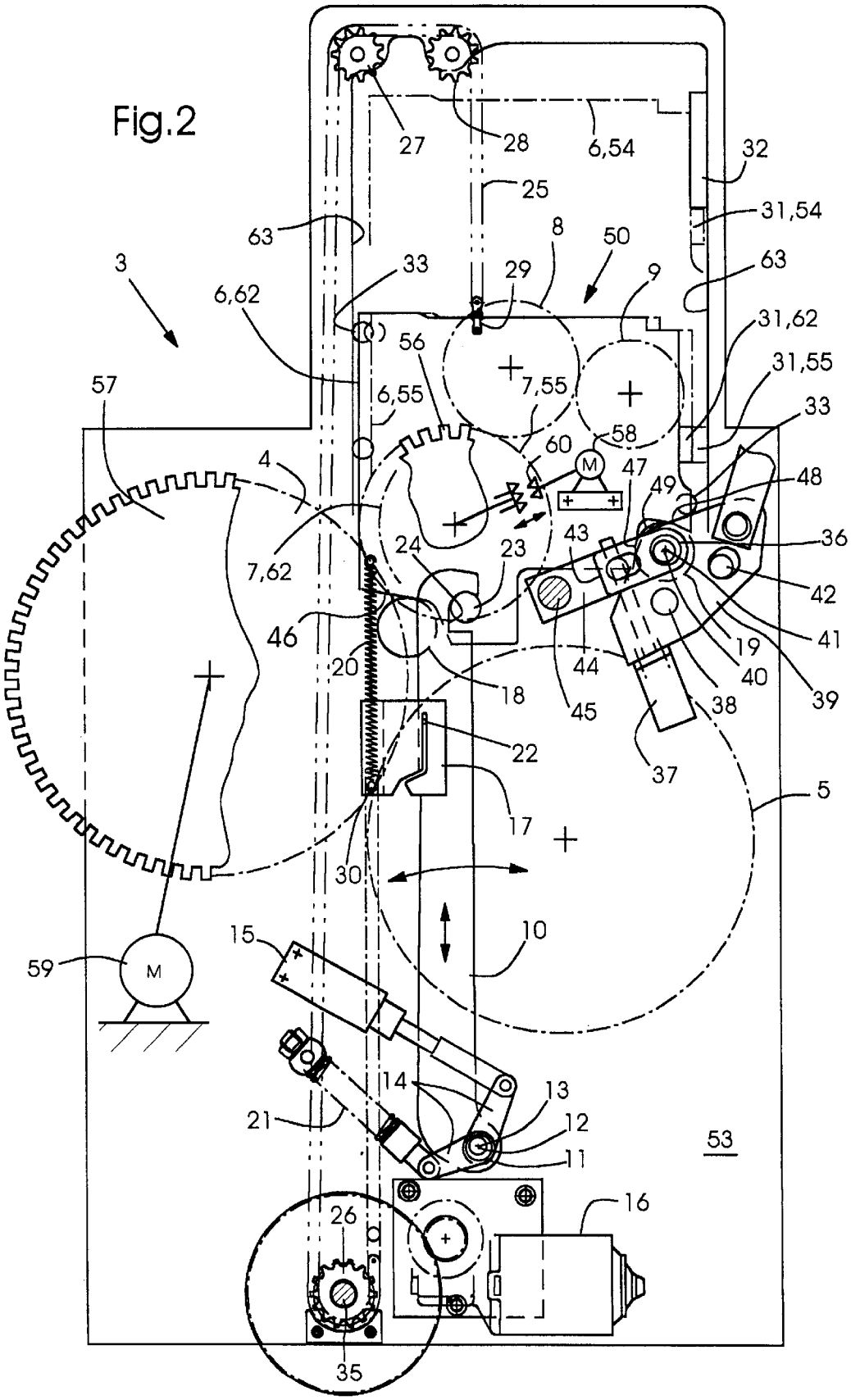
FIG. 2 is an enlarged fragmentary view of FIG. 2 showing the finishing unit with the positioning device according to the invention in greater detail.

FIG. 2 illustrates the finishing unit 3 shown in FIG. 1 in detail. The finishing unit 3 includes a positioning device for selectively positioning at least the cylinder 7, which is rotatably mounted in the carrier 6 and, together with the carrier 6, forms a unit 50 that is adjustable into different positions 54, 55 and 62. The unit 50 and the carrier 6, respectively, are adjustable by a mechanism (including a pull mechanism 25, particularly, a chain, and three wheels or sprockets 26, 27, and 28) along a first direction of motion and, in the course thereof, are disposable onto a guide 18, 19. The unit 50 thus seated on the guide 18, 19 is then adjustable along a second direction of motion, guided by the guide 18, 19. The unit 50 is adjustable by the mechanism (25 to 28) from a maintenance and replacement position shown in phantom at 54 in FIG. 2, in a vertical direction to a rest position shown in phantom at 55. In the position 55, the unit 50 is seated on the guide 18, 19, and the cylinder 7 has a minimum spacing from the cylinder 4 carrying the printing material and from the printing material lying on the cylinder 4, respectively. The unit 50, guided by the guide 18, 19 that is formed as an adjustable support or rest, is adjustable from the position 55 into an operating position shown in solid lines at 62, wherein the cylinder 7 cooperates with the cylinder 4 carrying the printing material, and applies the coating liquid to the printing material lying on the cylinder 4. The adjustment of the unit 50 from the position 54 into the position 55 is performed nearly or precisely in the vertical direction and, from the position 55 into the position 62, in a direction that differs from the vertical. The carrier 6 is formed of two side walls, which are arranged offset from one another in the axial direction of the cylinders 7 to 9, between which the cylinders 7 to 9 are arranged and in which the cylinders 7 to 9 are rotatably mounted. The guide 18, 19 includes at least one eccentric 19 that is rotatable about an eccentric bearing 36. Furthermore, the guide 18, 19 includes at least one roller 18, 19. The at least one roller 18, 19 may be the eccentric 19 itself. In the device illustrated in FIG. 2, the eccentric 19 is formed as a roller, and an additional roller 18 is provided whereon the carrier 6 is placed with a guide surface 46 thereof inclined with respect to the horizontal. The eccentric 19 is mounted in a pivoting lever 39 that is pivotable about a pivot bearing 38. By pivoting the pivoting lever 39, the unit 50 can be pivoted out of the position 55 and into the position 62, and back again. By rotating the eccentric 19 about the eccentric bearing 36, the position of the unit 50 relative to the bearing plate 39 formed as a pivoting lever is adjustable, and thus the spacing between the cylinder 7 and the cylinder 4 in the operating position 62 can be adjusted and the spacing is able to be adapted or matched to the thickness of the printing material, respectively. The eccentric bearing 36 is formed of a pin that is mounted in the bearing plate 39, and a bushing that is seated on the pin and is rotatable about the pin axis 40 by the lever 43. The pin and the pin axis 40, respectively, are eccentric relative to the center of the bushing, which corresponds to the axis of rotation 41 of the roller 19 that is rotatably seated on the bushing.

In a modification, the pin and bushing can be connected to one another so that they are fixed against rotation relative to one another, and the pin can be mounted rotatably in the bearing plate 39. Eccentric bearings are common in various constructions and, in addition to those described hereinbefore, other functionally identical constructions may also be used. The pivot axis 12 of the pivot bearing 11 is comparable with the axis 41, the eccentric axis 13 of the pivot bearing is comparable with the axis 40, and the lever 14 for adjusting the pivot bearing 11 is comparable with the lever 43. The function and the purpose of the pivot bearing 11 will be explained hereinafter. The eccentric 19 is rotatable by an actuating drive 37 that is constructed, for example, as an electric motor, the actuating drive 37 rotating the eccentric 19 via the lever 43. The roller 18 is rotatably mounted in a side wall of the frame 53. The guide 18, 19 preferably includes two or more rollers 18 and two or more rollers 19, which are, respectively, arranged so that they align coaxially and are offset relative to one another perpendicularly to the plane of the drawing of FIG. 2, and on which the unit 50 is seated on both sides so that it is secure against tilting. Simultaneous rotation of the two rollers 19 is in this case possible via a synchronizing shaft 45 that drivingly couples the two rollers 19, and is rotated by the actuating drive 37 via the lever 44. The carrier 6 has a surface 47 to 49 having two regions 47 and 48 which support the carrier 6 on the roller 19, and a non-contact region 49 located between the supporting regions 47 and 48, and having a spacing between the surface 47 to 49 and the circumferential surface of the roller 19. Instead of the two straight supporting regions 47 and 48 extending towards one another at an angle, the entire surface 47 to 49 may also be concavely curved. The mechanism is constructed as a pull mechanism drive including a pull mechanism 25, particularly, a chain, and three wheels or sprockets 26, 27, and 28, that adjusts the cylinder 7 and the unit 50, respectively, into the positions 54 and 55 and includes a pull mechanism 25, the unit 50 being held on the pull mechanism 25, suspended from the latter. The pull mechanism drive (25 to 28) is constructed as a form-paired or paired-form pull mechanism drive, the pull mechanism 25 of which is guided by at least two and, for example, three wheels 26 to 28 having a form or shape paired with or matching, i.e., complementary to, that of the pull mechanism 25. The pull mechanism drive (25 to 28) is specifically constructed as a chain transmission or drive having a link chain serving as the pull mechanism 25, the wheels 26 to 28 being sprockets engaging in the chain 25, and via which the chain 25 runs. An end 29 is loaded or stressed when the unit 50 is lifted, the chain end 29 being led from above to the unit 50 and fastened to the carrier 6 without springs, while an end 30 of the chain that is without loading or stress during the lifting operation and is led up from below is connected to the carrier 6 and suspended from the latter, respectively, by a spring 20. The pull mechanism drive (25 to 28) is driven by the actuating drive 16, which may be an electric motor, for example, via the drive wheel 26, so that the carrier 6, together with the cylinder 7, can be lifted and lowered selectively into the positions 54 and 55 in a linear and approximately vertical direction of motion by the pull mechanism drive (25 to 28). Like the guide 18, 19, the pull mechanism drive (25 to 28) is also provided in duplicate, a further such pull mechanism drive (25 to 28) for lifting and lowering the unit 50 being arranged offset at right angles to the plane of FIG. 2 and being substantially identical with the illustrated chain drive. The end of the further pull mechanism drive following on and being relieved of the loading when the unit is lifted can, however, be suspended on the unit 50 without a spring. The non-illustrated further pull mechanism drive likewise includes a drive wheel that, like the drive wheel 26, is fastened to the synchronizing shaft 35, so that the two pull mechanism drives are coupled and, operating in parallel, can be driven jointly by the actuating drive 16. The carrier 6 can be locked to the frame 53 by the pivoting lever 10, the locked pivoting lever 10 being pivotable about the pivot bearing 11 while the locking action is being maintained. The pivoting lever 10 and the carrier 6 are couplable with one another by a releasable formlocking connection 23, 24, the pivoting lever 10 being hooked to the carrier 6 and to a part fastened to the latter, respectively. In this regard, it is again noted that a formlocking connection is one that connects two elements together due to the shape of the elements themselves, as opposed to a forcelocking connection that locks the elements together by force external to the elements. Instead of the hook-like construction of the pivoting lever 10, in a possible reversal of the arrangement, the carrier 6 may also have a hook to catch the pivoting lever 10 and a part fastened to the latter, respectively. The illustrated formlocking connection 23, 24 includes the bolt 23 that is fastened to the carrier 6 and about which, during the coupling action, the claw 24 formed on the pivoting lever 10 partially engages. The pivot bearing 11 is adjustable so that, during the adjustment, a pivot axis 12 of the pivot bearing 11 is displaced. For example, the pivot bearing 11 is constructed as an eccentric bearing comparable with the eccentric bearing 36 for displacing the roller 19. The pivot bearing 11 is adjustable via the double lever 14, counter to the restoring action of the spring 21, by an operating cylinder that is used as the actuating drive 15 and that can be acted upon, for example, pneumatically, by a pressurized fluid. The pivoting lever 10 is pivotable by a cam drive or mechanism 17, 22 made up of a connecting link guide 17 and a part 22 guided in the latter. The cam mechanism 17, 22 is constructed so as to drive a pivoting movement of the pivoting lever 10 about the pivot bearing 11 for coupling and hooking, respectively, the pivoting lever 10 to the carrier 6. The connecting link guide 17, formed as a slotted plate, is fastened to the pull mechanism 25 at the end 30 of the chain, and the part 22 guided in the connecting link guide 17 is formed as a pin fastened to the pivoting lever 10. The course of the guide track or slot formed in the connecting link guide 17 is angled off and, at least in sections, is not parallel to the first direction of motion of the unit 50 along the adjustment path between the positions 54 and 55. The locking device 10 to 20, 22 to 24 may be provided in duplicate on both sides of the unit 50, like the guide 18, 19.

The aforedescribed individual functions of the finishing unit 3 are described hereinafter in context once more, by way of example. The operator of the printing machine 1 inserts the unit 50 into the finishing unit 3 in the readily accessible position 54 and attaches the unit 50 to the ends 29 and 30 of the chain. The actuating drive 16 is then activated, so that the unit 50 is lowered from the position 54 until the unit 50 is seated with the surface 46 to 48 on the rollers 18 and 19. During the lowering operation, the unit 50 hangs virtually freely on the pull mechanism 25 and is able to swing to the righthand and lefthand sides in the drawing plane of the figure, to a minimal extent. If the chain acts so that it is offset in the horizontal direction from the mass center of gravity of the unit 50, and the unit 50 is tilted slightly in the plane of the drawn figure, the rollers 33 rest on the walls 63 and, in another embodiment with a chain acting at the center of gravity and the unit 50 hanging undisturbedly on the chain, the rollers 33 may be spaced slightly from the walls 63. During the operation of lowering the unit 50, the slot or groove formed in the coulisse or connecting link guide 17 is pushed over the pin 22, which is then pushed into the downwardly open, wedgeshaped end of the slot or groove formed in the coulisse or connecting link guide 17. During further movement of the connecting link guide 17, which is pulled by the pull mechanism 25, the pivoting lever 10 is adjusted from a non-illustrated pivoting lever position wherein the claw 24 does not yet enclose the pin 23 (unlocked condition) into the pivoting lever position illustrated in FIG. 2, wherein the claw 24 and the pin 23 have a formlocking connection with one another (locked condition). After the unit 50 has been placed onto the guide 18, 19, the pull mechanism 25 tightens or causes a tensioning of the spring 20, the tensioning travel of which is utilized to pivot the pivoting lever 10 into the locking position thereof. This inward pivoting movement is completed when the hook-like end of the pivoting lever 10 encloses the pin 23, and the pin 22 has reached the latching position thereof illustrated in FIG. 2. The coulisse or connecting link guide 17 fastened to the chain 25 is suspended in a sprung manner to the unit 50, just like the end 30 of the chain, so that during the tensioning of the spring 20, the connecting link guide 17 is pulled away somewhat from the unit 50 in the tensioning direction a distance corresponding to the spring travel. The previously occurring locking of the pivoting lever 10 to the carrier 6, and the placing of the unit 50 securely on the guide 18, 19 are then effected by the actuating or adjusting drive 15, the latter being deactivated and, for example, when the actuating drive 15 is formed as a pneumatic cylinder, being vented, so that the spring 21 reverses the eccentric adjustment of the pivot bearing 11. As a result of the adjustment of the pivot bearing 11, the pivoting lever 10 is pulled to a minimum extent in the direction of the pivot bearing 11, or downwardly, so that the locking is secured, by the uppermost inner surface of the claw 24 being pressed firmly onto the circumferential surface of the pin 23, as shown in FIG. 2. The locking can be secured in a forcelocking or formlocking manner by pressing the inner surface onto the pin 23. Forcelocking protection is provided when the top inner surface has a rectilinear contour, so that when the pivoting lever 10 is pivoted to the lefthand side, as viewed in FIG. 2, the area pressure and friction, respectively, acting between the pin 23 and the inner surface pressed onto the latter prevents the claw 24 from slipping off the pin 23, and has the effect of causing the pin 23 and, therefore, the unit 50 to remain coupled to the pivoted pivoting lever 10. Formlocking protection is provided when the top inner surface is formed as a recess that is open at the bottom and that, when the pivoting lever 10 is adjusted downwardly, engages about the pin 23 on both sides from above.

For example, the inner surface can have a concave rounding matching the diameter of the pin, the concave rounding being disposed around that half of the pin circumference which is directed upwardly, so that the pin 23 is secured against slipping out of the claw 24 during any pivoting of the pivoting lever 10 both to the lefthand and to the righthand sides as viewed in FIG. 2. As a result of the high transmission ratio of the eccentric bearing 11, the spring 21, formed as a compression spring acting upon a spring rod, is able to apply a high tensioning force for fixing the unit 50 held by the pivoting lever 10 on the guide 18, 19. When the unit 50 is securely fixed, the actuating drive 16 can be deactivated. By pivoting the bearing plate 39 about the pivot bearing 38 thereof, the unit 50 seated on the guide 18, 19 is adjusted along the second direction of motion, guided by the guide 18, 19, towards the impression cylinder 4, from the position 55 (rest position) into the position 62 (operating position). This adjustment is also referred to hereinafter as pressure switching, following the usage of terms that is common for printing units. The spacing between the circumferential surface of the applicator cylinder 7 located in the position 62 and the circumferential surface of the impression cylinder 4, and the pressure of the applicator cylinder 7 against the printing-material sheet to be coated that is lying on the impression cylinder 4, respectively, is possible due to rotation of the eccentric bearing 36, the center of the roller 19, and thus the unit 50 supported on the roller 19, being displaced. This very fine adjustment performed by the actuating or adjustment drive 37 that is formed as an electric stepping motor is also referred to hereinbelow as pressure adjustment. Both during pressure switching and during pressure adjustment, the unit 50 is displaced by an adjustable part of the guide 18, 19, namely the roller 19, and, in this regard, is displaced nearly tangentially along an ideal circular path that the hook-like end of the pivoting lever 10 describes about the pivot bearing 11 during the pivoting operation. An insignificant relative movement of the unit 50 during pressure switching and pressure adjustment, radially relative to the pivot bearing 11, is reliably compensated for by the readjusting action of the spring 21. Due to the great length of the pivoting lever 10 and the great spacing between the locking point and the pivot bearing 11, respectively, during the displacement of the unit 50 on the guide 18, 19, the spring 21 is further subjected to tension and relieved, respectively, only to an insignifant extent, depending upon the respective direction of displacement. The drive or drives effecting the pressure switching and the pressure adjustment, for example, the actuating drive 37, only have to overcome, in addition to the actuating or adjusting forces, the rolling friction in the bearing surfaces of the guide 18, 19, resulting from the pretensioning. The actions of unlocking and removing the unit 50 are performed in the opposite manner, virtually in reverse sequence. For the purpose of unlocking, air is applied to the pneumatic cylinder 15 and the locking device 23, 24 is rendered ineffective via the eccentric bearing 11. The motor 16 then drives the chain 25 and relieves the tension on the spring 20 from which the coulisse or connecting link guide 17 is suspended. The pivoting lever 10 is thereby pivoted away from the illustrated position thereof to the lefthand side of the figure, as viewed in the plane thereof, so that the pin 23 becomes free. The motor 16 which, in this regard, drives the chain 25 in the opposite direction, has the effect of lifting the unit 50 off the guide 18, 19 and adjusting it back along the first direction of motion into the readily accessible maintenance position 54, wherein the stop 31 of the unit 50 lies on the stop 32 of the frame 53, and from which the operator can remove the unit 50 from the finishing unit 3. Instead of the pneumatic cylinder 15, in a further development of or improvement in the device, the movement of the chain can also be used to open the locking device.

If the cylinder 7 cooperates with the cylinder 4 carrying the printing material and, for example, applies a coating liquid to a printing-material sheet lying on the cylinder 4, the cylinder 7 is driven by the drive 59 via the gearwheels 56, 57 by the mechanical coupling, so as to match the cylinder 4. The drive 58 serves to adjust the angle of the cylinder 7 and drives the cylinder 7 during maintenance work, for example, during the cleaning of the latter and any changing of the cylinder cover, the unit 50 and hence the cylinder 7 being located in the readily accessible maintenance position 54.

Figure 3:
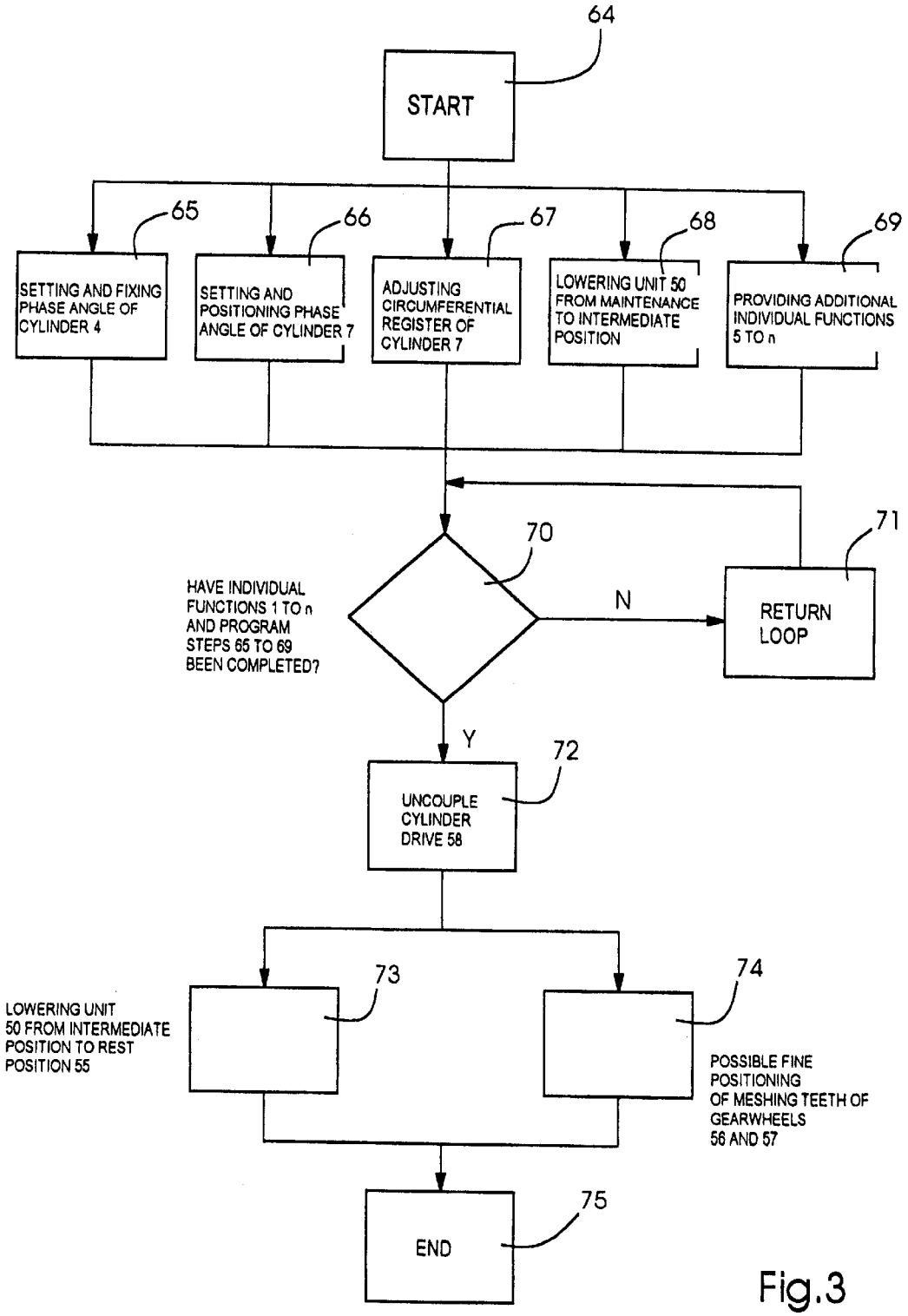
FIG. 3 is a flow chart depicting a program for controlling various actuating or adjusting operations in the finishing unit by a programmable electronic control device.
Figure 4:
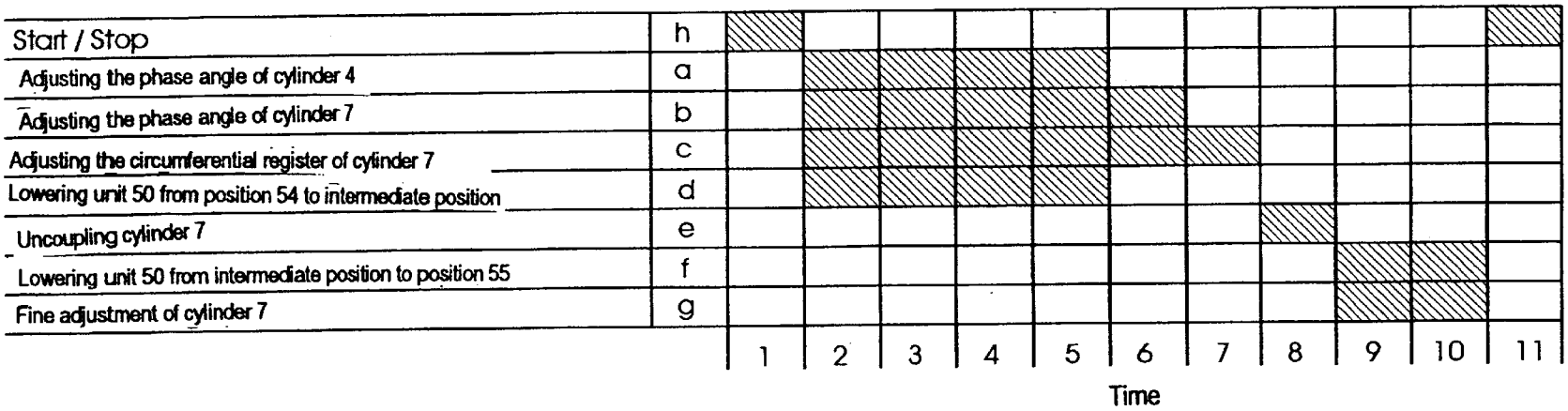
FIG. 4 is a timing diagram showing the sequence over time of various method steps to be performed during the operation of the printing machine and to be coordinated timely with one another.

FIGS. 3 and 4 illustrate a method of operating the printing machine 1 which includes a positioning device having a cylinder 7 that is adjustable into various positions 54 and 55 along an adjustment path, and cooperates with a cylinder 4 carrying printing material. The method calls for at least two of the method steps a) to d) to be performed, and that these two method steps be performed at least partly simultaneously:

a) adjusting the rotational angle of the cylinder 4 carrying the printing material into a specific rotational angle position (phase angle), b) adjusting the rotational angle of the cylinder 7 that is adjustable along the actuating or adjustment path into a given or specific rotational angle position (phase angle), c) adjusting the circumferential register of the cylinder 7 that is adjustable along the adjustment path, and d) adjusting the cylinder 7 from a first cylinder position into a second cylinder position along the adjustment path, by using the positioning device.

The advantages of the method according to the invention result from the chronological overlap and the parallel progress, respectively, of a number of actuating operations needed to place the printing machine 1 into operation. It is preferable if different drives 16, 58, 59 (FIG. 2) of the printing machine 1, driving individual actuating or adjusting operations a) to d), are controlled by a, for example, programmable electronic control device 61 (FIG. 1), so that they are coordinated with one another and chronologically in accordance with the method steps to be performed.

In the method, at least three of the method steps a) to d) can be performed, and at least two of the at least three method steps that are performed can be performed at least partly simultaneously. In specific applications, it is possible to dispense, in particular, with performing the method step c).

In a further and different mode of the method, all four method steps a) to d) can be performed and, of these, at least two method steps can be performed at least partly simultaneously.

A further and different mode of the method calls for at least three of the method steps a) to d) of the at least three or four method steps a) to d), which are performed, to be performed at least partly simultaneously.

A further and different mode of the method provides for all four method steps a to d to be performed at least partly simultaneously.

Of the method steps that are performed at least partly simultaneously, respectively, at least two method steps can begin more or less simultaneously, i.e., precisely or nearly simultaneously. It is also possible for the performance of at least three of the method steps, which are performed at least partly simultaneously, to begin more-or-less simultaneously.

According to a further different mode of the method, provision may be made for beginning the performance of all four method steps a) to d) more-or-less simultaneously.

In a further different mode of the method, provision is made, in addition to the method steps (two, three or all four method steps) respectively performed by the method steps a) to d), a further method step e) is to be performed, as follows:

e) uncoupling the adjustable cylinder 7 from a drive 58 rotatively driving the cylinder 7 (FIG. 2).

The performance of the method step e) can begin chronologically after the method step b) has been completed. The adjustment of the rotational angle of the cylinder 7 according to the method step b) can thus be effected by the drive 58 coupled with the cylinder 7. The coupling 60 (FIG. 2) serves, in this regard, for coupling and uncoupling the drive 58. The performance of the method step e) can also begin chronologically after the method step d) has been completed or after the method step c) has been completed. The method step e) can also be performed chronologically after the completion of all of the respectively performed method steps of the method steps a) to d). A further and different mode of the method provides for another method step f), as follows, to be begun chronologically after the method step d) has been completed:

f) adjusting the cylinder 7 from the second cylinder position into a third cylinder position along the adjustment path.

Carrying out the method step f) can begin chronologically after the respective performed method steps a) to d) have been completed. The performance of the method step f) can also begin chronologically after the method step e) has been completed.

In a further different mode of the method, the performance of an additional method step g) can begin after the method step e) has been completed:

g) finely adjusting or aligning the rotational angle position of the cylinder 7 in relation to the rotational angle position of the cylinder 4 guiding the printing material.

The method step g) can be performed at least partly simultaneously with the method step f). The method step g) can also be performed precisely simultaneously with the method step f), the method steps being performed in parallel, and beginning and ending simultaneously.

FIG. 3 illustrates a flow chart of a program, in accordance with which the various hereinaforedescribed actuating operations in the finishing unit and the printing machine 1, respectively, are controllable by the programmable electronic control device 61. The chronological sequence of the individual method steps while the unit 50 shown in FIG. 2 is being moved down from the position 54 thereof into the position 55 thereof is explained hereinbelow, by way of example, using program steps 64 to 75. Program step 64 contains the start of the program, wherein driving the unit 50 down from the position 54 into the position 55 begins. The following program steps 65 to 69 are executed in parallel, the phase angle of the impression cylinder 4 being set and fixed in the program step 65 by the main drive 59 of the printing machine 1, which rotatively drives the impression cylinder 4. In the program step 66, the phase angle of the applicator cylinder 7 is likewise set and positioned by the drive 58 which is integrated into the unit 50, rotatively drives the applicator cylinder 7, and is movable together with the unit 50. In the program step 67, an adjustment of the circumferential register of the applicator cylinder 7 is performed with a varnishing plate, for example, that is located on the cylinder 7 being aligned precisely in-register. In the program step 68, the unit 50 is lowered from the maintenance position 54 thereof into an intermediate position thereof (not otherwise specifically illustrated in FIG. 2), that is located between the maintenance position 54 and the rest position 55. In this intermediate position, a gearwheel 56 that is drivingly connected to the cylinder 7 and, for example, is seated on the journal of the cylinder 7, is still not yet engaged with a gearwheel 57 that is drivingly connected to the cylinder 4 and, for example, is seated on the journal thereof, and the cylinder 7 is secured against rotation by an otherwise non-illustrated securing device, it being possible for a yet very slight rotational clearance of the cylinder 7 to exist which may be necessary for the teeth of the gearwheels 56 and 57 to find one another. In the program step 69, in addition to the individual functions 1 to 4 performed in the program steps 65 to 68, further individual functions 5 to n may be provided. The program step 70 performs an interrogation, or inquires as to whether the individual functions 1 to n and the program steps 65 to 69, respectively, have been completed. The program step 71 represents a loop through which the program runs if the condition according to program step 70 has not yet been satisfied. Once all the operations 1 to n have been completed, the cylinder drive 58 is uncoupled in the program step 72. The driving connection between the applicator cylinder 7 and the drive 58, for example, an electric motor, is broken by releasing the coupling 60. In the succeeding program step 73, the unit 50 is lowered from the intermediate position thereof into the rest position 55 thereof illustrated in FIG. 2. In parallel with the program step 73, a not always necessary fine positioning of the engagement or meshing of the teeth of the gearwheel 56 arranged coaxially with the applicator cylinder 7 and the teeth of the gearwheel 57 arranged coaxially with the cylinder 4 guiding the printing material may be performed in program step 74, and the gearwheel 56 is brought into meshing engagement with the gearwheel 57 as a result of the unit 50 being lowered. The program ends with program step 75. In the case wherein a free wheel with a small free-wheel clearance is incorporated between the drive 58, on the one hand, and the cylinder 7 and the gearwheel 56, respectively, on the other hand, the drive 58 may also be uncoupled from the cylinder 7 only at a later instant of time, when the teeth of the gearwheels 56 and 57 have already been brought into meshing engagement with one another. The gearwheels 56 and 57 are thus interengaged or meshed both in the rest position 55 and in the operating position 62. The adjustment travel of the unit 50 from the operating position 62 thereof into the rest position 55 thereof is not so great that the gearwheel teeth come out of meshing engagement in the process. If the cylinder 7 cooperates with the cylinder 4 guiding the printing material and, for example, applies a coating liquid to a printing-material sheet lying on the cylinder 4, the cylinder 7 is driven by the drive 59, so as to coordinate with the cylinder 4, by the mechanical coupling via the gearwheels 56 and 57. The drive 58 is used for the aforedescribed angular adjustment of the cylinder 7, and also drives the cylinder 7 during maintenance work, i.e., when the cylinder is being cleaned and during any cylinder cover change, the unit 50 and hence the cylinder 7, in this case, being located in the readily accessible maintenance position 54. When the finishing unit 3 is a varnishing unit, for example, the cylinder cover may be a varnishing plate. In the case wherein the in-line operated finishing unit 3 is a finishing unit that deformingly processes the printing-material sheet, i.e., by embossing or stamping, the cylinder cover may be fitted with corresponding tools. In the case of a finishing unit 3 formed as a numbering or imprinting unit, the cylinder cover may be a printing plate. The cylinder cover may be changed automatically or semi-automatically, and the cylinder 7 may be cleaned, for example, by washing the cylinder cover, manually or in an automated manner by a cleaning device. Both in the case of the changing of the cylinder cover and in the case of the cleaning, the cylinder 7 and, if necessary or desirable, further cylinders 8 and 9 to be cleaned, which belong to the unit 50 and are mounted in the carrier 6, are driven by the drive 58.

FIG. 4 represents a so-called timing or time rate of change diagram which shows the course over time of the various method steps a) to h) to be performed during the operation of the printing machine 1 and to be coordinated chronologically with one another. The method steps a) to h) are identified as the darkly shaded areas of the time bars running horizontally. While the method steps are thus plotted on the ordinate axis of the diagram, the abscissa axis is subdivided into eleven equally large time units, it being possible for the time duration actually corresponding to a time unit to be, for example, ten seconds but being of no significance for the explanation of the progress of the individual method steps. The method steps a) to d) correspond to the program steps 65 to 68, and the method steps e) to g) correspond to the program steps 72 to 74, and the method step h) represents a combination of the program steps 64 and 75. It is shown that the method steps a) to d), on the one hand, and the method steps f) and g), on the other hand, respectively, begin simultaneously. All the method steps a) to d) are performed in parallel and simultaneously, respectively, over the time units 2 to 5. The term "at least partly simultaneously" is to be understood as a chronological overlap of method steps which, it may be assumed, would also be provided in the case of the method steps b) and c) if the method step b) were to be completed at the end of the time unit 4 and the method step c) were to begin only at the start of the time unit 4. In this case, explained by way of example, the method steps b) and c) would be performed simultaneously, at least during the time interval 4. Also shown in the timing diagram is that the method steps e), f) and g) begin after the method steps a) to d) have been completed, and the method steps f) and g) begin after the method step e) has been completed. The method steps f) and g) are performed precisely simultaneously, i.e., these method steps not only overlap chronologically but, respectively, begin and end at a common instant of time.

Figure 5:
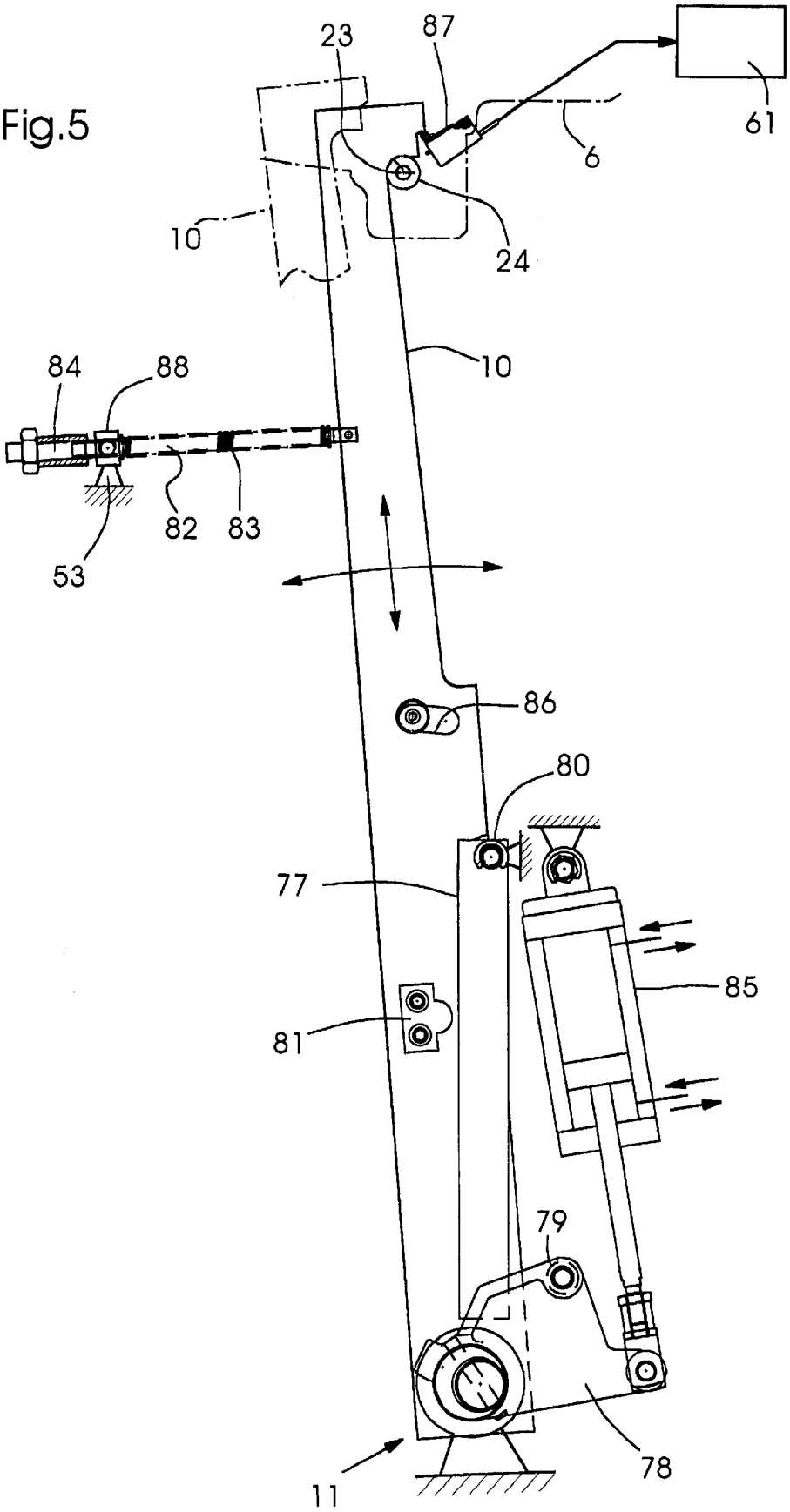
FIG. 5 is an enlarged fragmentary view of FIG. 2 showing another embodiment of a lever transmission for pivoting a pivoting lever of the positioning device.

FIG. 5 shows the essential parts of a modified embodiment of the device illustrated in FIG. 2. Instead of the cam mechanism for pivoting the pivoting lever 10 shown in FIG. 2, in the modified embodiment according to FIG. 5, the pivoting lever 10 is pivoted by a lever mechanism. Besides the parts which are omitted in the modified embodiment and are identified by the reference numerals 14, 15, 17, 21 and 22 (FIG. 2), the device shown in FIG. 5 has all the parts shown in FIG. 2 in the same arrangement, even if those parts have not been illustrated completely in FIG. 5 for reasons of improved clarity. Those parts shown in FIG. 2 which are also again illustrated in FIG. 5, are identified by the same reference numerals.

The pivoting of the pivoting lever 10 in the counterclockwise direction, as shown in FIG. 5, is performed counter to the action of a helical spring 83 supported on the frame and seated on a rod 82 articulatedly connected to the pivoting lever 10. The pivoting movement in the counterclockwise direction which unlocks the pivoting lever 10 from the carrier 6 is driven by the actuating drive 85 and is performed via a lever 78 that adjusts the eccentric bearing 11 and that, simultaneously, presses against a lever 77 which is pivotable about the hinge 80 fixed to the frame and which, in turn, presses against a stop 81 fastened to the pivoting lever 10. The actuating drive 85 is formed as an operating cylinder to which compressed air is applicable and which, when the piston rod is retracted, initially has the effect of adjusting the eccentric bearing 11, so that the pivoting lever 10 is displaced slightly upwardly in the longitudinal direction thereof and, subsequently, via the parts 78, 79 and 81, pivots the pivoting lever 10 counter to the action of a spring 83 about the bearing 11, so that the pivoting lever 10 and the carrier 6 are unhooked from one another. The lever 77 is formed as a single-armed lever which, at one end thereof, is mounted in the hinge 80 so as to hang down loosely and, on the other end thereof forming a long lever arm, presses the roller 79 fastened to the lever 78, so that a region of the lever 77, which results in a short lever arm of the lever 77 and is located between the two ends of the lever 77, strikes against the stop 81 and adjusts the pivoting lever 10 via this stop 81 that is fastened to the pivoting lever 10. The spring 83 formed as a helical spring and wound around the rod 82 can be loaded in compression. The rod 82 is mounted in the frame 53 via a rotating and sliding joint 88, and is connected articulatedly to the pivoting lever 10. The pivoting lever 10 uncoupled from the carrier 6 is illustrated in phantom fragmentarily in FIG. 5. The locking of the pivoting lever 10 and the carrier 6 is performed in the opposite manner. When the application of compressed air to the double-action operating cylinder 85 is changed over or switched, the spring force of the spring 83, that is supported on the frame, acts via the rod 82, which is both pivotably and displaceably mounted in the frame 53, upon the pivoting lever 10, so that the latter is pivoted in clockwise direction and strikes the pin 23 fastened to the carrier 6. The movement of the pivoting lever 10 in the clockwise direction is damped by the damper or dashpot 84, so that the impact of the pivoting lever 10 on the pin 23 takes place very gently. The damper 84 is formed as a piston damper, the piston rod of which is formed by the rod 82 or is coupled to the latter. An adjustment of the eccentric bearing 11 that pulls the pivoting lever 10 downwardly in the longitudinal direction thereof causes the inner surface of the claw 24 to be pressed against or onto the top of the pin 23, this being effected by applying compressed air to the operating cylinder 85 in the direction opposite to that for unlocking, thereby extending the piston rod of the operating cylinder 85. A sensor 87 is used to signal the present coupling state of the pivoting lever 10 and the carrier 6 to the electronic control device 61 of the printing machine 1. The drive 59 (FIG. 2) is deactivated by the control device 61, for example, when the control device 61 interrupts a circuit that supplies the drive 59, if the pivoting lever 10 and the carrier 6 are not correctly coupled when the unit 50 is moved downwardly. The sensor 87 is fastened to the carrier 6 and is formed as an electrical microswitch which can be operated by the pivoting lever 10 and senses the correct locking of the latter to the carrier 6. A guide 86 is formed as a headed screw which is screwed into the frame 53 and is guided in a slot formed in the pivoting lever 10, and which secures the pivoting lever 10 against tilting at right angles to the drawing plane of FIG. 5.

We claim:

1. A device for selectively positioning at least one cylinder in a printing machine, the cylinder being rotatably mounted in a carrier and, together with the carrier, forming a unit that is adjustable into different positions, comprising a pull mechanism drive for adjusting one of the cylinder and the unit into the different positions, said pull mechanism drive including a pull mechanism, said unit being held on and suspended from said pull mechanism.

2. The device according to claim 1, wherein said pull mechanism drive is a form-paired pull mechanism drive.

3. The device according to claim 2, wherein said pull mechanism drive is a chain drive.

4. The device according to claim 1, wherein said pull mechanism is a link chain.

5. The device according to claim 1, including a spring connecting an end of said pull mechanism to said carrier.

6. The device according to claim 1, including at least two wheels for guiding said chain drive, said wheels being form-paired With said chain drive.

7. The device according to claim 1, wherein the cylinder is an applicator cylinder for applying a coating to a printing material.

8. The device according to claim 1, including at least another cylinder rotatably mounted in the carrier.

9. The device according to claim 1, including a guide whereon the carrier is seatable.

10. The device according to claim 9, wherein said guide is formed as at least one roller whereon the carrier is seatable.

11. The device according to claim 1, wherein the carrier is liftable and lowerable together with the cylinder through the intermediary of said pull mechanism drive in a linear and an approximately vertical direction of motion selectively into the different positions.

12. A printing machine having at least one positioning device according to claim 1.

* * * * *